US006651976B2

(12) United States Patent
Ohfuchi

(10) Patent No.: US 6,651,976 B2
(45) Date of Patent: Nov. 25, 2003

(54) SHEET FEEDING AND IMAGE FORMING APPARATUS AND METHOD

(75) Inventor: Tetsuya Ohfuchi, Matsudo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/163,306

(22) Filed: Jun. 7, 2002

(65) Prior Publication Data

US 2003/0001330 A1 Jan. 2, 2003

(30) Foreign Application Priority Data

Jun. 7, 2001 (JP) ..... 2001-172860
Dec. 26, 2001 (JP) ..... 2001-395345

(51) Int. Cl.[7] ..... B65H 1/00

(52) U.S. Cl. ..... 271/145; 271/162; 271/163; 271/164; 271/170

(58) Field of Search ..... 271/145, 162, 271/163, 164, 170

(56) References Cited

U.S. PATENT DOCUMENTS 4,623,138 A * 11/1986 Sakamaki et al. ..... 271/170

FOREIGN PATENT DOCUMENTS

| | | | | |
|---|---|---|---|---|
| JP | 58022224 A | * | 2/1983 | ..... B65H/1/04 |
| JP | 03293227 A | * | 12/1991 | ..... B65H/1/26 |
| JP | 5-262433 | | 10/1993 | |
| JP | 9-77291 | | 3/1997 | |
| JP | 9-175677 | | 7/1997 | |
| JP | 10-59553 | | 3/1998 | |

OTHER PUBLICATIONS

Patent Abstracts of Japan, JP 9–077291, Mar. 25, 1997.
Patent Abstracts of Japan, JP 9–175677, Jul. 8, 1997.

* cited by examiner

*Primary Examiner*—Donald P. Walsh
*Assistant Examiner*—Matthew J. Kohner
(74) *Attorney, Agent, or Firm*—Oblon, Spivak, McClelland, Maier & Neustadt, P.C.

(57) ABSTRACT

A sheet feeding apparatus includes a sheet containing tray withdrawable from a housed position to a front side of an apparatus body of the image forming apparatus. A sheet feeding device is provided so as to feed sheets in the sheet containing tray in a direction perpendicular to a withdrawal direction of the sheet containing tray. A pair of side aligning members is also provided so as to align widthwise ends of the sheets. A rear side aligning member mounts a hitching member so as to hitch and prevent a jammed sheet from remaining in the apparatus body of the image forming apparatus when the sheet containing tray is withdrawn. The hitching member includes a horizontally protruding plate so as to overhang the uppermost sheet set on the sheet containing tray at a position a prescribed length downstream of a downstream end of the rear side aligning member. A joining portion is also provided so as to join the protruding plate and the rear side aligning member. The joining portion is positioned a prescribed length behind a rear side end of the sheets.

9 Claims, 11 Drawing Sheets

SHEET FEEDING AND IMAGE FORMING APPARATUS AND METHOD

CROSS REFERENCE TO RELATED APPLICATIONS

This application is related to and claims priority, under 35 U.S.C. §119, from Japanese Patent Application No. 13-172860, filed on Jun. 7, 2001 in the Japanese Patent Office, the entire contents of which are hereby incorporated by reference herein.

BACKGROUND OF THE INVENTION

1. Field of the Invention

The present invention generally relates to a sheet feeding apparatus for use in an image forming apparatus, such as a copier, a facsimile, a printer, etc. and more particularly, to a sheet feeding apparatus including a sheet containing tray having a side guide member that aligns side ends of sheets contained in the sheet containing tray and withdrawable from the image forming apparatus in a direction perpendicular to a sheet feeding direction.

2. Discussion of the Background

A so-called front loading type sheet feeding apparatus has been known in the past. Specifically, a front loading type sheet feeding apparatus includes: a sheet containing tray withdrawable from a housed position to a front side of the apparatus body; a sheet feeding device for feeding sheets in a direction approximately perpendicular to the withdrawal direction of the sheet containing tray; and a pair of side guide members extending in parallel to a sheet feeding direction for aligning side ends of the sheets. As illustrated in FIG. 7, a pair of rear and front side fences 101 and 102 are arranged to align side ends of sheets P in a widthwise direction B perpendicular to the sheet feeding direction A in a sheet containing tray 100 of such a front loading type of sheet feeding apparatus. Also provided is an end fence 103 for aligning a sheet trailing end upstream of the sheet feeding direction A.

The sheets P are raised by a bottom plate lifting apparatus (not shown) and then fed by the sheet feeding device, such as a feeding roller, when the uppermost sheet reaches a sheet feeding position located at a prescribed height "h" for the sheet feeding device. In the sheet feeding apparatus, when the sheets P are fed and a sheet jam occurs in the sheet containing tray, a leading end of a jammed sheet P' possibly remains in the vicinity of the feeding roller. Thus, when a user draws the sheet containing tray 100 in the widthwise direction B in order to remove the jammed sheet P', the jammed sheet P' can unfortunately climb over a rear side fence 101. In particular, when a small size sheet is utilized, a problem sometimes arises such that the small size sheet sneaks through a gap "s" formed between a right side wall 100' of the sheet containing tray 100 and the rear side fence 101, and remains in the apparatus body of the image forming apparatus as illustrated by a dotted line in FIG. 7. When the jammed sheet P', after having climbed over the rear side fence 101, remains in the apparatus body of the image forming apparatus, it is difficult for a user to remove the jammed sheet P', and a situation known as "call jam," requiring a request to a service person, arises. Accordingly, a prompt jam recovery operation is disadvantageously not achieved. As a result, a working ratio is lowered.

Japanese Patent Application Laid Open No. 9-77291 refers to a sheet remaining avoiding mechanism used for the similar purpose. Specifically, a protruding section is upwardly formed from the rear side fence 101, and is setback from a rear side of a sheet setting range (i.e., a rear side end of a sheet P). Thus, when the sheet containing tray 100 is withdrawn, the jammed sheet P' collides with the rear side fence 101 and is largely bent. However, jammed sheet P' is not blocked by the protruding section and climbs over the rear side fence 101 and the protruding section. If the protruding section hangs over at a position certainly higher than an upper surface of the rear side fence 101, a jammed sheet P' can surely be prevented from climbing over the rear side fence 101 and the protruding section. However, due to multi-step tendency in sheet containing trays of an image forming apparatus of recent date, a height per a step is suppressed, and as a result, that of the vertically protruding section cannot sufficiently be assigned.

Further, the sheet remaining avoiding mechanism of Japanese Patent Application Laid Open No. 9-175677 has a complex configuration. Specifically, sheet replenishment is disadvantageously difficult because a pair of sheet suppressing members largely horizontally protrude from respective rear side and front side fences 101 and 102 toward a sheet stack range.

SUMMARY OF THE INVENTION

Accordingly, an object of the present invention is to address and resolve the above-noted and other problems of prior art sheet feeding apparatus and to provide a new sheet feeding apparatus. The above and other objects are achieved according to the present invention by providing a novel sheet feeding apparatus including a sheet containing tray withdrawable from a housed position to a front side of an apparatus body. A sheet-feeding device is provided so as to feed a sheet in the sheet containing tray in a direction perpendicular to the withdrawal direction of the sheet containing tray. A pair of side aligning members are also provided so as to align widthwise ends of the sheets in the sheet containing tray. The aligning member of the rear side in the withdrawal direction includes a hitching member, horizontally protruding toward a sheet setting range, to hitch and prevent a sheet from remaining when the sheet containing tray is withdrawn. The hitching member includes a protruding plate so as to overhang the uppermost sheet set on the sheet containing tray at a position a prescribed length downstream of a downstream end of the rear side-aligning member. A joining member is also provided so as to join the protruding plate and the rear side aligning member. The joining member positions a prescribed length behind a rear side end of the sheets aligned by the rear side aligning member.

In another embodiment, the protruding plate slightly protrudes from the rear side end of the sheets.

In yet another embodiment, the protruding plate includes a slanted and bent portion at its front side or rear side.

BRIEF DESCRIPTION OF DRAWING FIGURES

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENT

Figure 1:
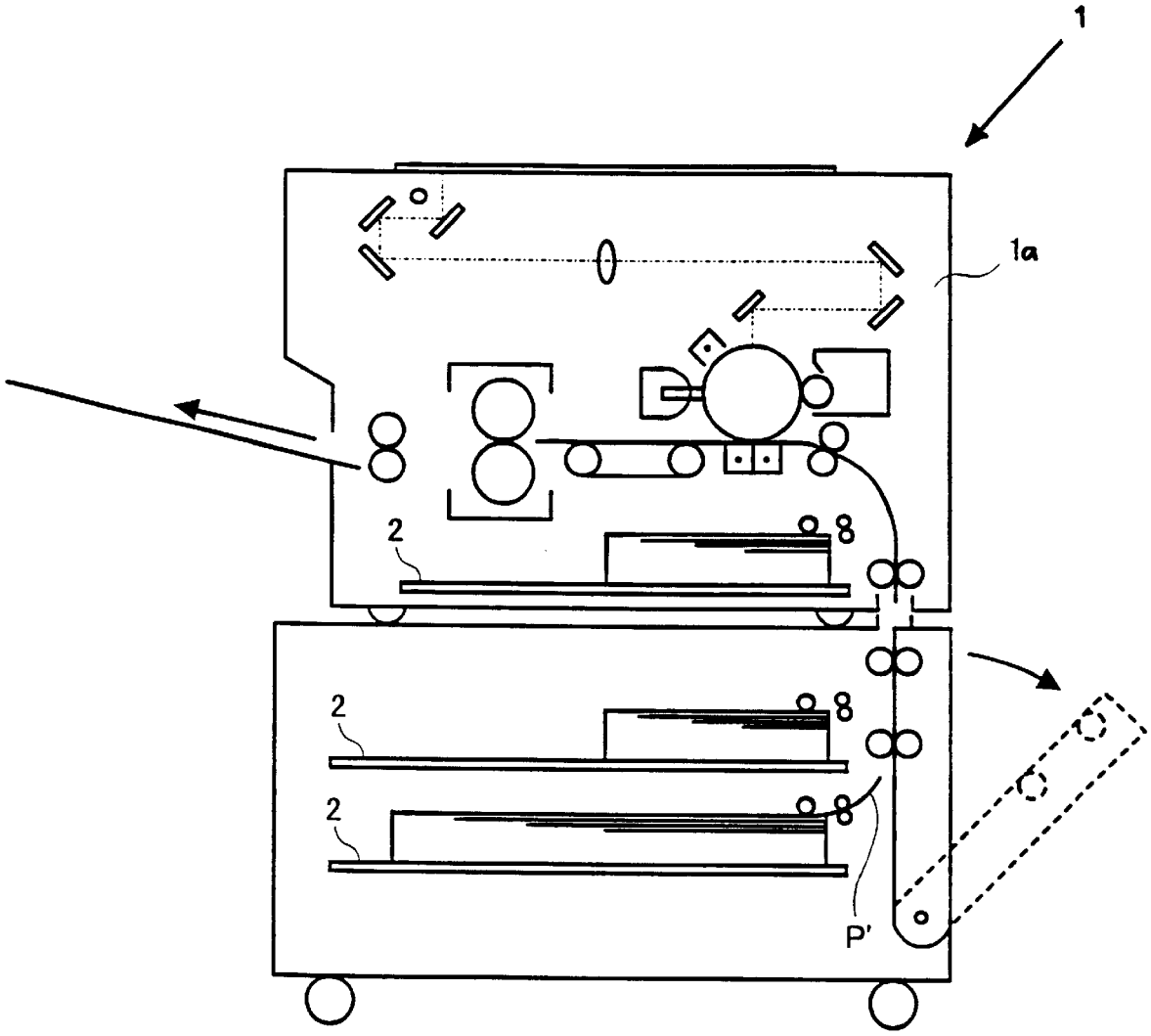
FIG. 1 is a schematic front elevational view illustrating an image forming apparatus employing a sheet feeding apparatus according to the present invention.
Figure 6:
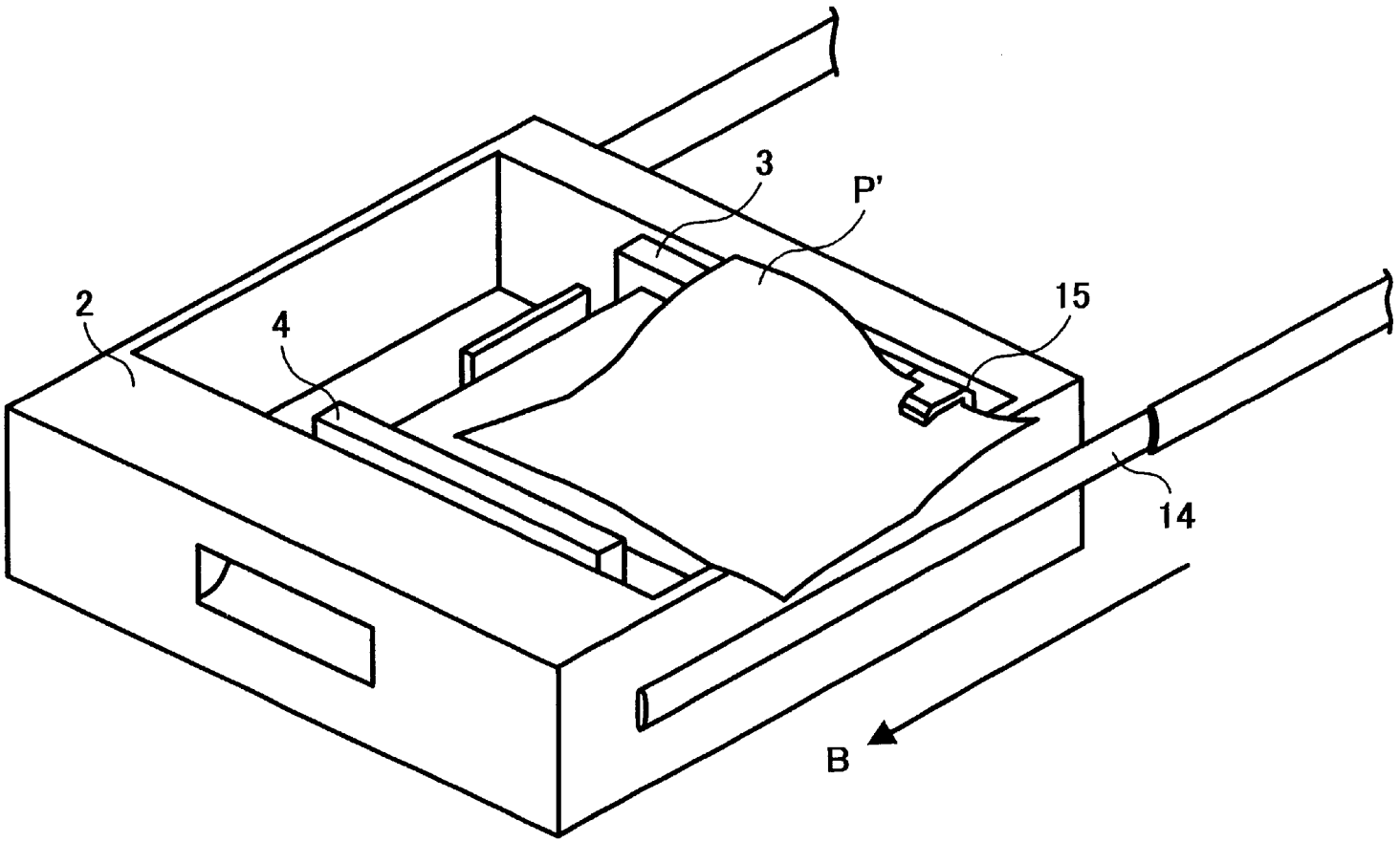
FIG. 6 is a perspective view for illustrating a sheet containing tray in the sheet feeding apparatus.
Figure 7:
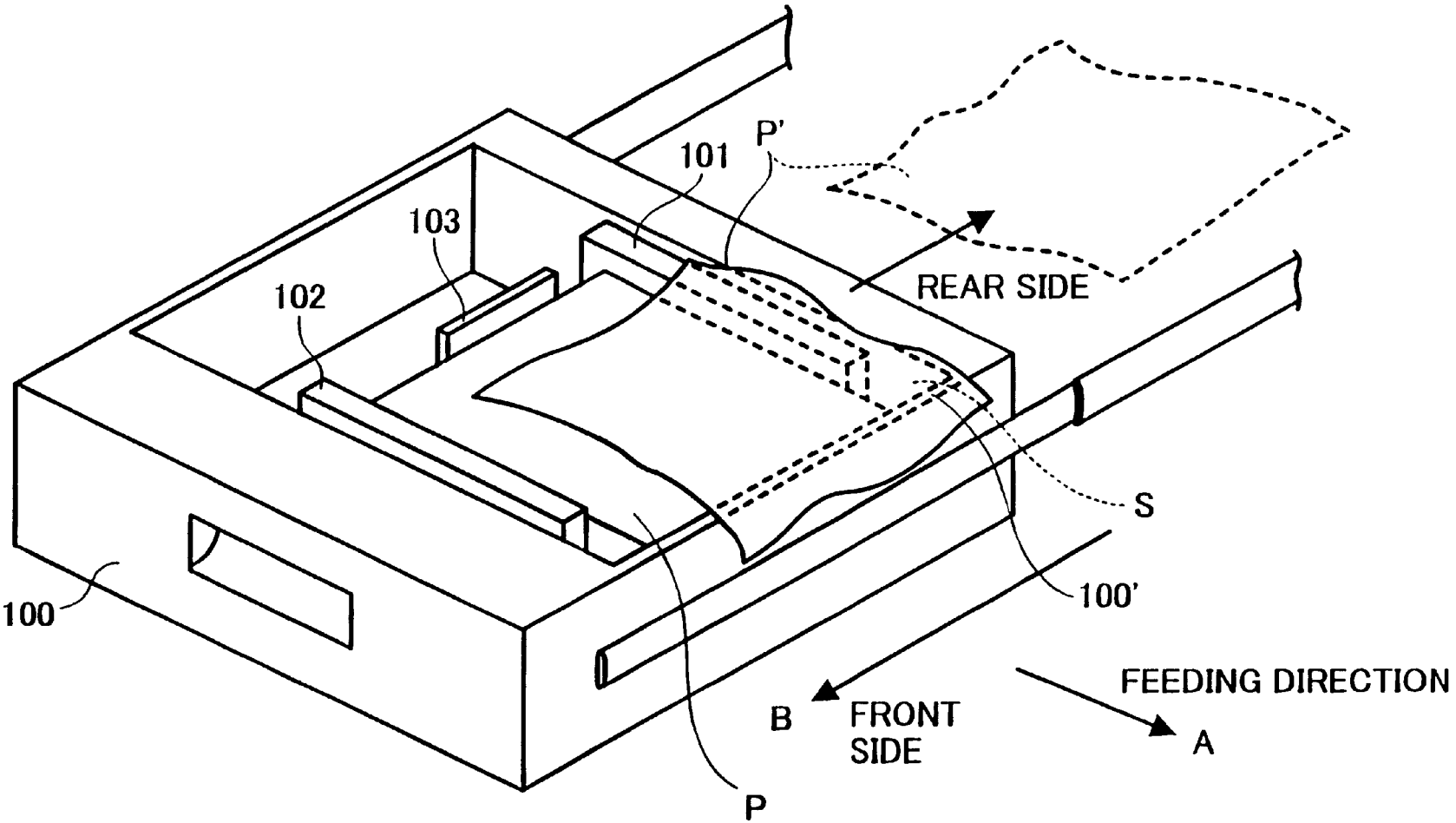
FIG.7 RELATED ART
FIG. 7 is perspective view for illustrating a conventional sheet feeding apparatus.

Referring now to the drawings, wherein like reference numerals designate identical or corresponding parts throughout the several views, and in particular to FIG. 1, a schematic front elevational view of an image forming apparatus having an exemplary sheet feeding apparatus is illustrated. In FIG. 1, a sheet containing tray attaching section may be formed in an apparatus body 1*a* of the image forming apparatus 1 so as to attach a sheet containing tray 2 or similar. Three sheet containing trays 2 may be typically arranged and are enabled to slide back and forth on rails 14 as illustrated in FIG. 6. Thus, the sheet containing tray 2 may be withdrawable from the apparatus body 1*a* of the image forming apparatus 1 in a forward direction shown by an arrow B from a front side of the apparatus body 1*a* of the image forming apparatus 1 as illustrated in FIG. 2.

Figure 2:
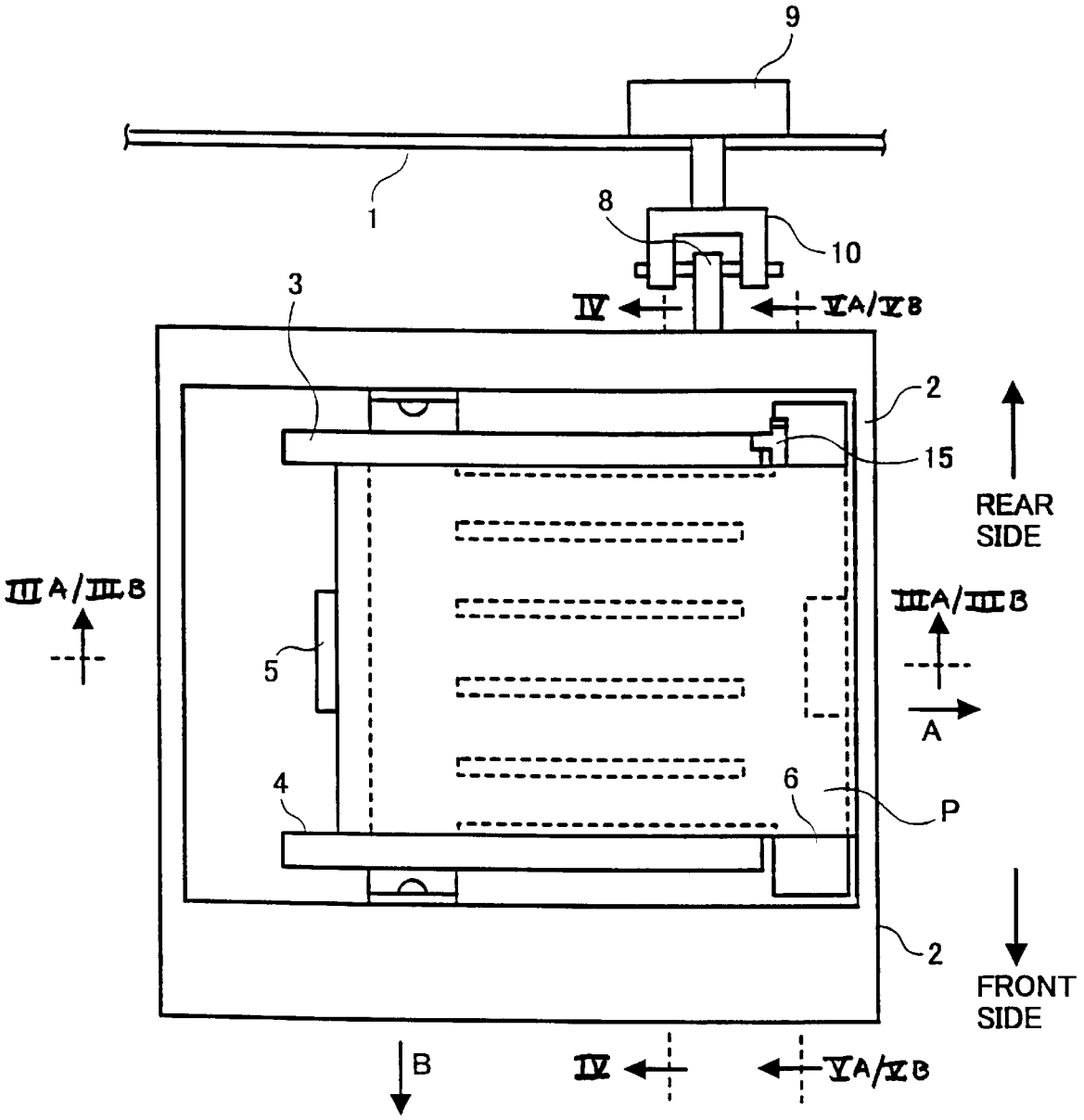
FIG. 2 is a top plan view for illustrating the sheet feeding apparatus according to the present invention.
Figure 3A:
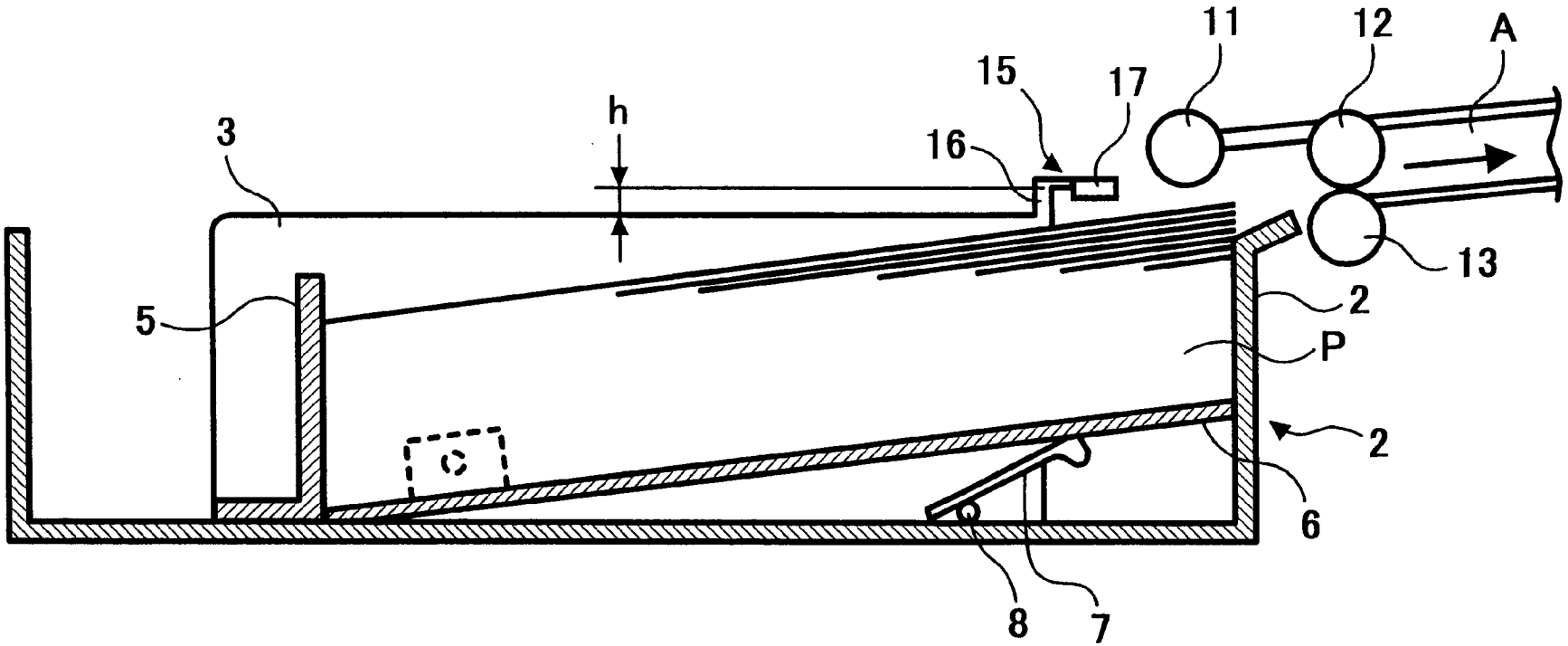
FIGS. 3A and 3B are a full cross-sectional view and a partial cross-sectional view, respectively, taken along line IIIA/IIIB—IIIA/IIIB of FIG. 2.
Figure 3B:
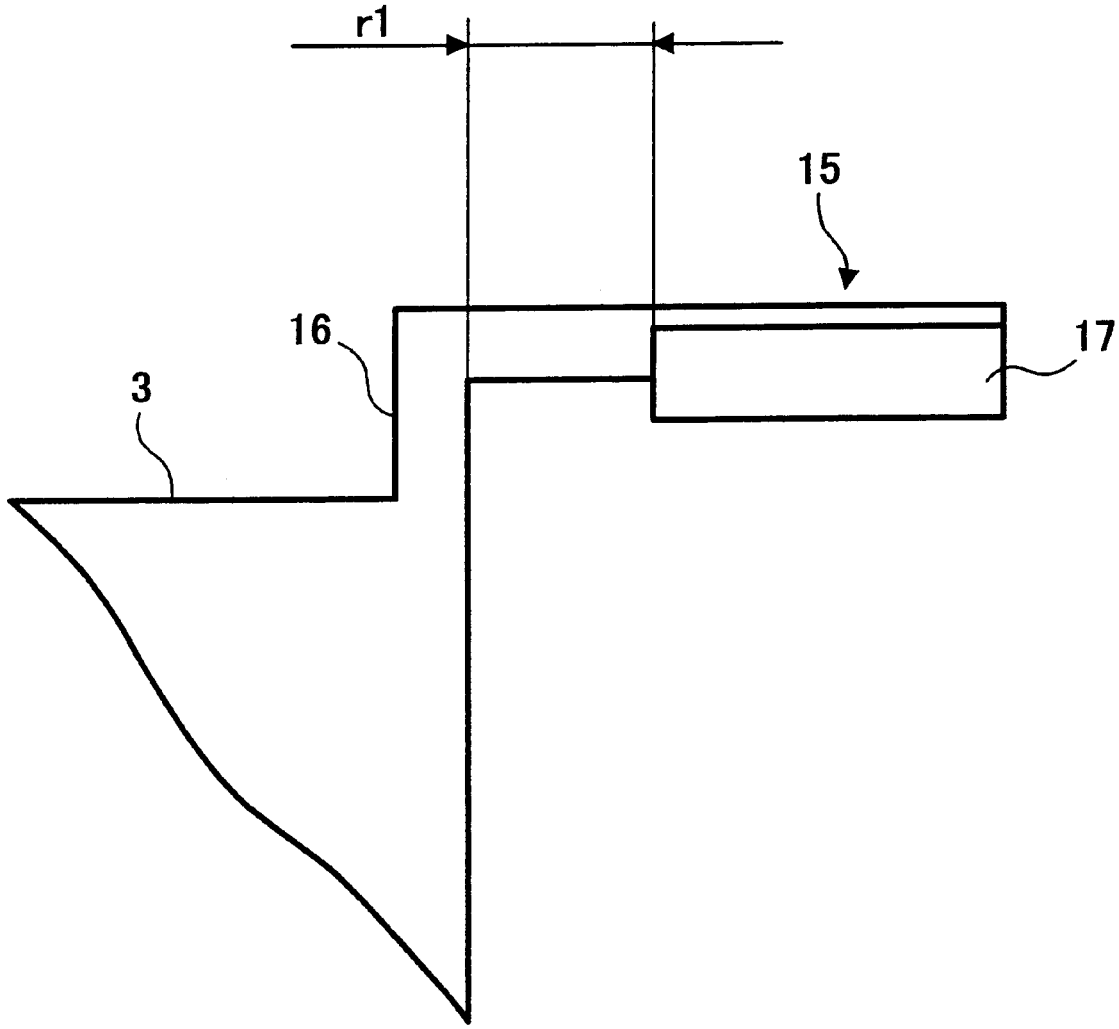
Figure 4:
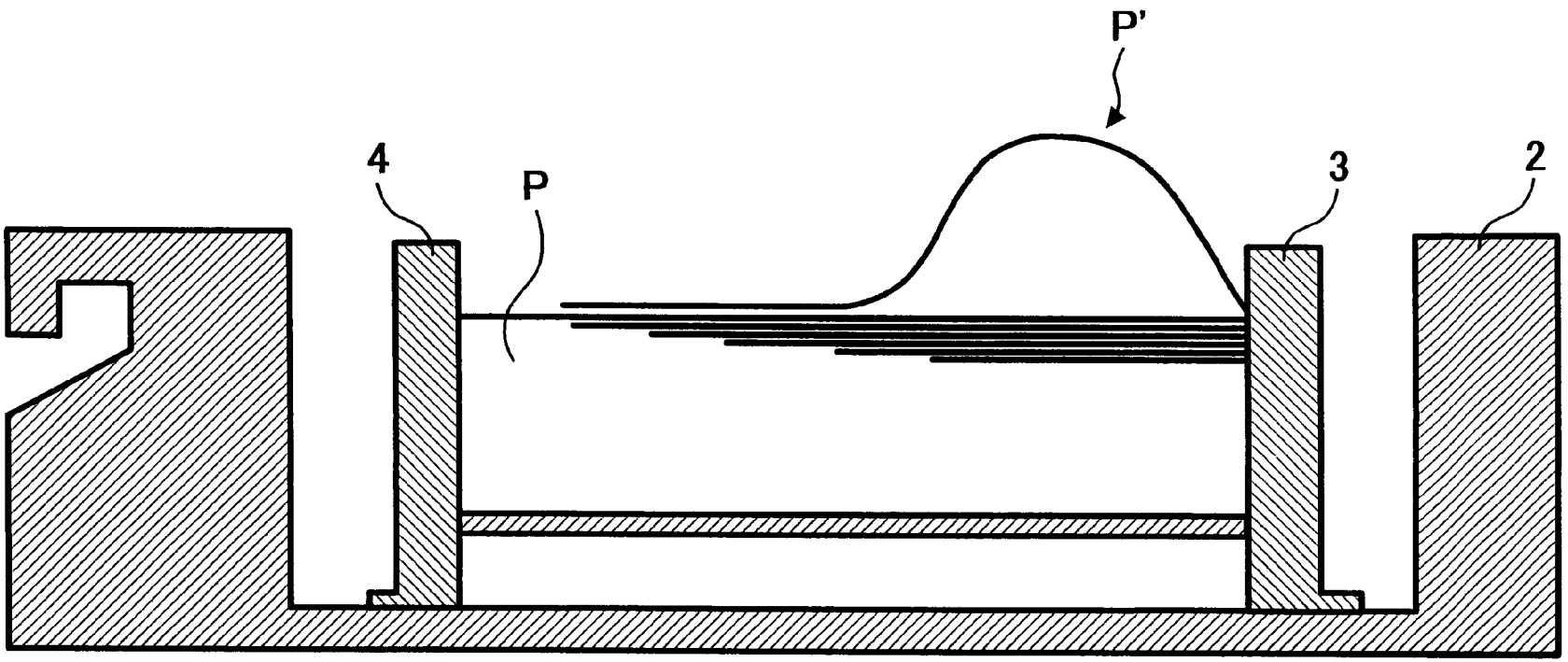
FIG. 4 is a cross-sectional view taken along line IV—IV of FIG. 2 for illustrating a bent condition of a sheet on a sheet containing tray.
Figure 5A:
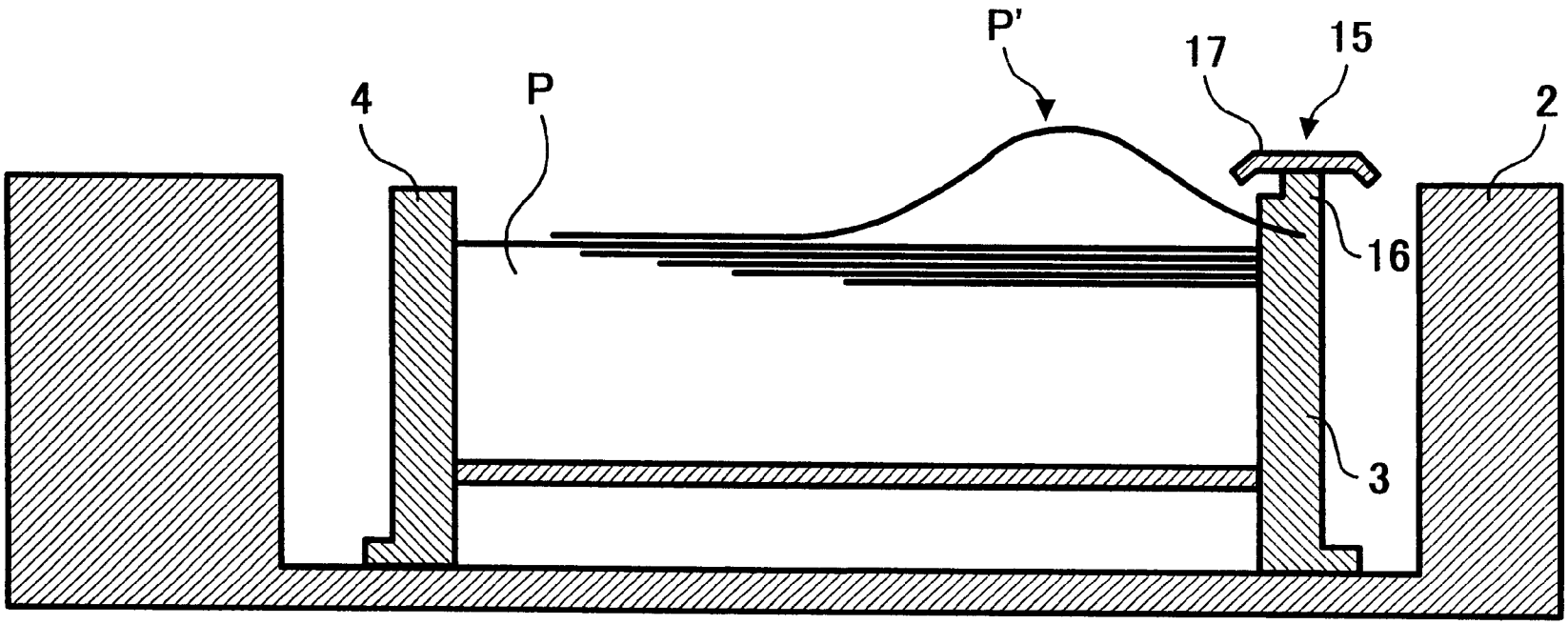
FIGS. 5A and 5B are a full cross-sectional view and a partial cross-sectional view, respectively, taken along line VA/VB—VA/VB of FIG. 2.
Figure 5B:
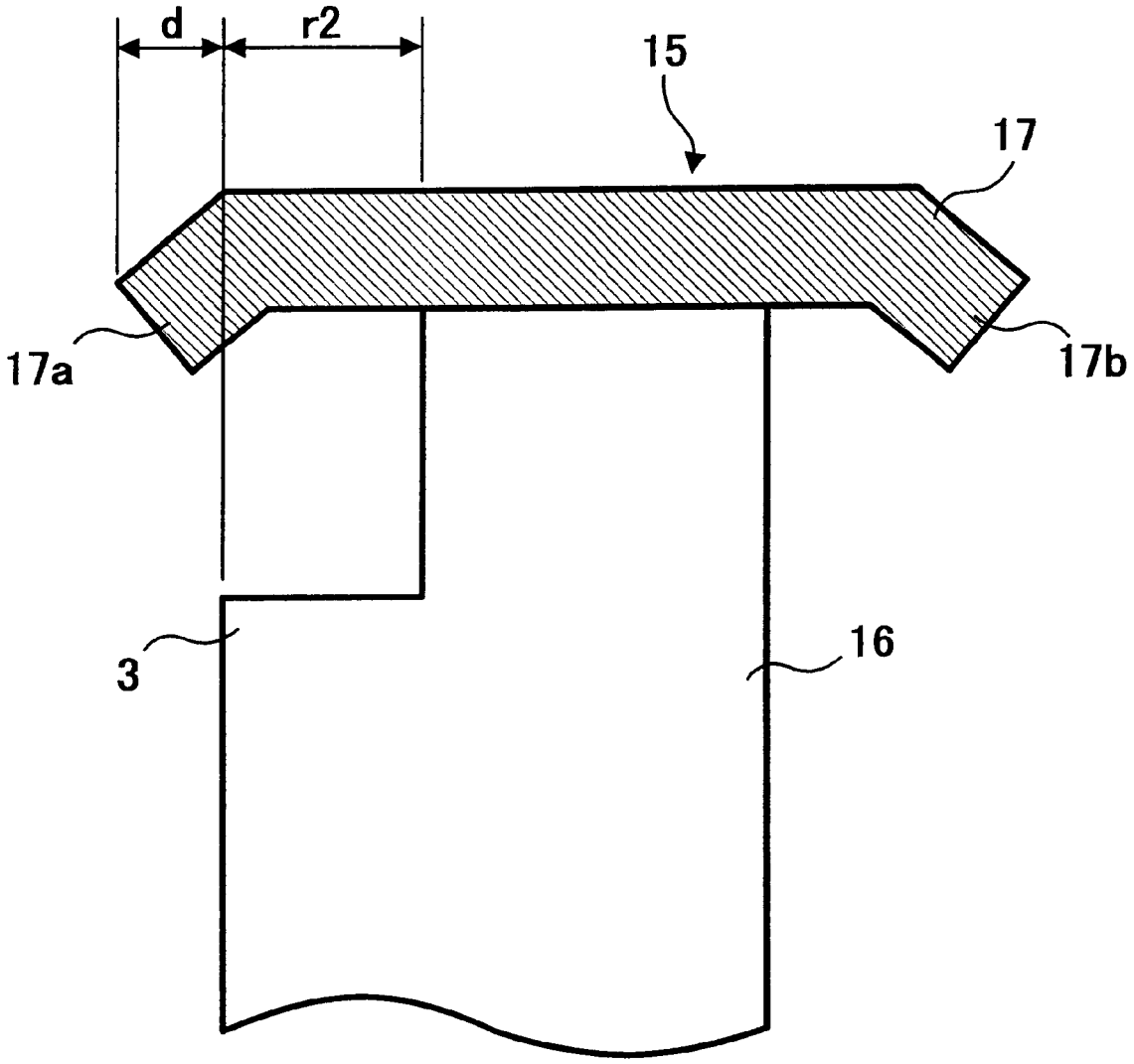

One of sheet containing trays 2 will now be described with reference to FIGS. 3A, 3B, 4, 5A, and 5B, wherein FIG. 3A illustrates a full cross-sectional view taken along line IIIA/IIIB—IIIA/IIIB of FIG. 2, FIG. 3B illustrates a partial cross-sectional view taken along line IIIA/IIIB—IIIA/IIIB of FIG. 2, FIG. 4 illustrates a full cross-sectional view taken along line IV—IV of FIG. 2, and FIGS. 5A illustrates a full cross-sectional view taken along line VA/VB—VA/VB of FIG. 2, and FIG. 5B illustrates a partial cross-sectional view taken along line VA/VB—VA/VB of FIG. 2. In FIGS. 2, 3A, 3B, and 4, the sheet containing tray 2 may include a pair of rear and front side fences 3 and 4 serving as side aligning members for aligning both side ends of a sheet P in a widthwise direction approximately perpendicular to a sheet feeding direction shown by an arrow A. Also included may be an end fence 5 for aligning a trailing end of the sheet P directed in the sheet feeding direction A. Such a sheet P may be set onto a bottom plate 6 as illustrated in FIG. 3. A bottom plate elevation apparatus may be provided. The bottom plate elevation apparatus includes an elevation arm 7 for lifting the bottom plate 6 and an elevation shaft 8 for rotating the elevation arm 7 below the bottom plate 6. An elevation motor 9 may be provided in the apparatus body 1*a* of the image forming apparatus 1 and transmit rotational driving force to the elevation shaft 8. When the sheet containing tray 2 is set in the apparatus body 1*a* of the image forming apparatus 1, a setting detection device (not shown) may detect the sheet containing tray 2, and then the elevation motor 9 may rotate. A coupling 10 may mesh and transmit the driving force to the elevation shaft 8. Thus, the elevation arm 7 may lift the bottom plate 6. When the uppermost sheet reaches a prescribed sheet feeding position, the elevation motor 9 may stop driving, and thereby a sheet feeding available condition may be entered. In contrast, when the sheet containing tray 2 is withdrawn from the apparatus body 1*a* of the image forming apparatus, the coupling 10 may disengage from the elevation shaft 8. As a result, the sheets P and bottom plate 6 may be lowered by gravity.

The sheet-feeding device provided in the apparatus body 1*a* of the image forming apparatus 1 may be a conventional friction separation type and mainly include a pickup roller 11, a feed roller 12, and a reverse roller 13. The pickup roller 11 and the feed roller 12 may be engaged with an idler (not shown). The reverse roller 13 may always be oppositely rotated to a feeding direction so as to separate sheets P one by one. Among the rear and front side fences 3 and 4 in the sheet feeding apparatus, a hitching member 15 may be mounted on the rear side fence 3 while being directed in the direction B that sheet containing tray 2 is withdrawn so as to hitch and prevent a sheet P from remaining in the apparatus body 1*a* of the image forming apparatus 1. The hitching member 15 may include a horizontally protruding plate 17 overhanging a sheet setting range, and a connecting member 16 for connecting the rear side fence 3 and the horizontally protruding plate 17.

In a first embodiment of the present invention, as illustrated in FIGS. 3A and 3B, the protruding plate 17 may overhang the uppermost sheet, the protruding plate 17 being disposed downstream of a downstream end of the rear side fence 3. Thus, a gap "r1" (i.e., a space where the protruding plate 17 is omitted) may be formed between the protruding plate 17 and the downstream side of the rear side fence 3. Further, a connecting member 16 may maintain the gap "r1," the connecting member being set back from the sheet setting range of the sheets P stacked in front of the rear side fence 3. Thus, another gap "r2" may be formed as illustrated in FIG. 5B. Further, the horizontally protruding plate 17 of FIG. 3A may be maintained at a prescribed height "h" not to contact the uppermost sheet when the bottom plate 6 is lifted.

Driving may be immediately stopped in order to prevent progression of the disease of a jam condition when a jam occurs in the apparatus body 1*a* of the image forming apparatus 1. In such a case, jam treatment is performed while opening a vertical sheet conveyance path as illustrated by a dotted line in FIG. 1. However, a jammed sheet P', whose leading end is stopped in the vicinity of the feed roller 12, cannot be treated because the jammed portion thereof is too far from the opening section to reach, and then the sheet containing tray 2 is withdrawn to the front side by an operator. The jammed sheet P' necessarily collides with the rear side fence 3 and thereby sometimes is largely bent by the rear side fence 3 as illustrated in FIG. 4 when the sheet containing tray 2 is withdrawn in the direction B as mentioned earlier. In this situation, if the hitching member 15 is positioned at a middle portion of the rear side fence 3 in the sheet feeding direction and upwardly extends there, the jammed sheet P' highly probably climbs over the rear side fence 3 and the hitching member 15 from its largely bent portion. In contrast, since the hitching member 15 is located downstream of the downstream side end of the rear side fence 3 as in the present invention, the jammed sheet P' may not collide with, or sometimes only slightly collide with, the rear side fence 3. Specifically, the jammed sheet P', which has a less bent amount at its downstream side end than the other portion of the sheet, may enter into the gaps "r1" and "r2" in this order, and then be hitched by the hitching member 15.

Further, since the hitching member 15 is located downstream of the downstream end of the rear side fence 3, a jammed sheet P' having a small size may be prevented from remaining, which is generally caused because its trailing end tends to sneak through a gap formed between the right side wall and the rear side fence 3.

As illustrated in FIG. 5A, since a front side end of the protruding plate 17 horizontally protrudes toward the sheet setting range by a slight amount "d", the jammed sheet P' may more easily enter into both the gaps "r1" and "r2". Specifically, it may credibly be hitched and withdrawn together with the sheet containing tray 2. The slight amount "d" may not spoil a sheet-setting performance in view of sheet bending when the stack of sheets P is set from above. Since the hitching member 15 protrudes toward the sheet setting range by the slight amount "d", a sheet P can be damaged depending upon a setting manner in the above described embodiment. Then, as illustrated in FIG. 5B, since the leading section (i.e., a front side end) of the protruding plate 17 includes a slanted and bent portion 17*a*, the slanted and bent portion 17*a* may guide a stack of sheets P when it is loaded and prevent the same from being damaged.

In addition, since the other leading section (i.e., a rear side end) of the protruding plate 17 also includes a slanted and bent portion 17*b*, both slanted and bent portions 17*a* and 17*b* may guide each sheet P of the stack of sheets P to the housed position while preventing the sheet containing tray 2 from colliding with either the apparatus body 1*a* of the image forming apparatus 1 or a upper sheet containing tray 2. In addition, sheet damage may also be prevented.

For the friction separation roller type sheet-feeding apparatus described earlier, a friction pad type sheet feeding apparatus can be employed. The above-described hitching member 15, which is integral with the rear side fence, can be separated therefrom. Further, the above-described sheet feeding apparatus, integral with the image forming apparatus 1, can be separated therefrom and employ the present invention.

Figure 8:
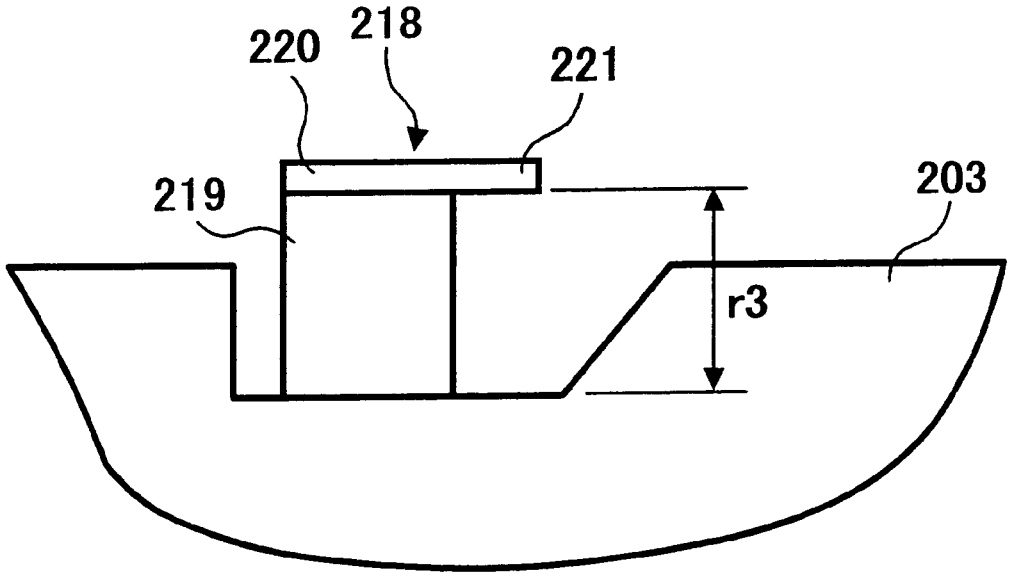
FIG. 8 is a partial cross-sectional view for illustrating a second hitching member according to the present invention.
Figure 9:
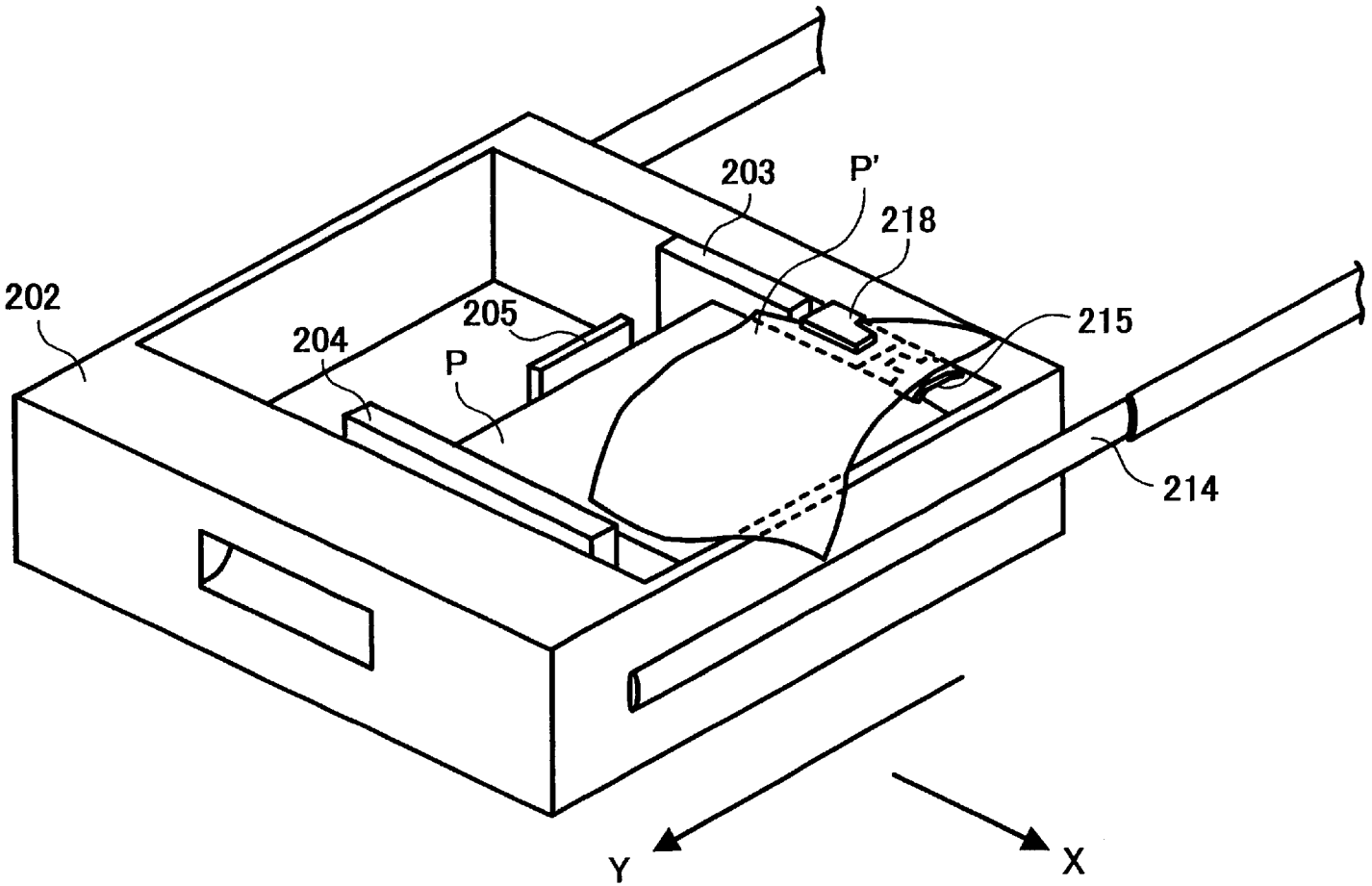
FIG. 9 is a perspective view for illustrating a condition when a jammed sheet climbs over a first-hitching member in the sheet feeding apparatus.

Further, as illustrated in FIGS. 8 and 9, a second hitching member 218 can be provided in addition to and in an upstream position of a first hitching member 215 on the rear side fence 203. The second hitching member 218 may also include a horizontally protruding plate 220 protruding forwardly of a rear side of the sheet setting range on the sheet containing tray 202, a connecting portion 219 for connecting the protruding plate 220 to the rear side fence 203, and an eave 221 projecting downstream from the protruding plate 220.

A height of the rear side fence 203 may be lowered at a portion attaching the second hitching member 218 than the remaining portion of the rear side fence 203. Thus, a gap "r3" may be formed between the protruding plate 220 and rear side fence 203.

Thus, even when the jammed sheet P' rarely climbs over the first hitching member 215, an upstream portion of the jammed sheet P' can possibly be hitched by the second hitching member 218 and enter into the gap "r3". Thus, the jammed sheet P' can be withdrawn together with the sheet containing tray 202.

Since the rear side fence 203 is lowered at the attaching portion of the second hitching member 218, the gap "r3" can be large enough to hitch a jammed sheet P'. In addition, the second hitching member 218 may also be set back from the sheet setting range, and the stack of sheets P may be prevented from colliding with the second hitching member 218 in order to avoid damage therefrom when set on the sheet containing tray 202. Further, the second hitching member 218 may preferably be positioned substantially at the center of a side of the smallest sheet among various sizes of sheets. In such a situation, it surely hitches the jammed sheet P' having the smaller size.

Obviously, numerous additional modifications and variations of the present invention are possible in light of the above teachings. It is therefore to be understood that within the scope of the appended claims, the present invention may be practiced otherwise than as specifically described herein.

What is claimed as new and is desired to be secured by Letters Patent of the United States is:

1. A sheet feeding apparatus, comprising:

a sheet containing tray withdrawable from a housed position to a front side of an apparatus body of an image forming apparatus employing the sheet feeding apparatus;

a sheet feeding device configured to feed a sheet from the sheet containing tray in a direction perpendicular to a withdrawal direction of the sheet containing tray;

a pair of side aligning members configured to align widthwise ends of sheets set within a sheet setting range in the sheet containing tray; and a hitching member mounted on the sheet containing tray behind a rear side of the sheets, wherein said hitching member is positioned on the sheet containing tray at a prescribed length downstream of a downstream end of a rear one of the pair of side aligning members.

2. The sheet feeding apparatus according to claim 1, wherein the hitching member is secured to the rear one of the pair of side aligning members.

3. The sheet feeding apparatus according to claim 1, wherein the hitching member includes a horizontally protruding plate configured to protrude toward the sheet setting range and overhang an uppermost sheet set in the sheet containing tray.

4. The sheet feeding apparatus according to claim 3, wherein the hitching member includes a joining member configured to join the protruding plate and the rear one of the pair of side aligning members, the joining member positioned at a predetermined distance behind a rear side of a sheet aligned by the rear one of the pair of side aligning members.

5. The sheet feeding apparatus according to claim 4, wherein the protruding plate forwardly slightly protrudes from the rear side sides of the sheets in the sheet containing tray so that sheet replenishment from above is substantially not interfered with by the protruding plate.

6. The sheet feeding apparatus, according to claim 4, wherein the protruding plate includes a slanted portion configured to guide the sheets to be replenished at a front side end thereof when sheets are replenished from above.

7. The sheet feeding apparatus according to claim 3, wherein the protruding plate includes a slanted portion configured to form a guiding portion at a rear side end thereof when the sheet feeding apparatus is housed.

8. An image forming apparatus including:

a visual image forming and transferring device configured to form and transfer a visual image onto a sheet; and a sheet feeding apparatus configured to feed a sheet to receive the visual image, wherein the a sheet feeding apparatus includes:

a sheet containing tray withdrawable from a housed position to a front side of an apparatus body of an image forming apparatus employing the sheet feeding apparatus;

a sheet feeding device configured to feed a sheet from the sheet containing tray in a direction perpendicular to a withdrawal direction of the sheet containing tray;

a pair of side aligning members configured to align widthwise ends of sheets set within a sheet setting range in the sheet containing tray; and a hitching member mounted on the sheet containing tray behind a rear side of the sheets, wherein said hitching member is positioned on the sheet containing tray at a prescribed length downstream of a downstream end of a rear one of the pair of side aligning members.

9. A method for hitching a jammed sheet jamming on a sheet containing tray, the method comprising the steps of:

providing a pair of side aligning members configured to align widthwise ends of sheets contained in the sheet containing tray;

providing a hitching member on the sheet containing tray behind a rear side of the sheets and downstream of a downstream end of a rear one of the pair of side aligning members; and withdrawing the sheet containing tray from a housed position to a front side of an apparatus body of an image forming apparatus employing the sheet containing tray when a jam occurs;

hitching a relatively small bent portion of the jammed sheet which is jamming into the hitching member in a vicinity of an outlet of the sheet containing tray when the step of withdrawing the sheet containing tray is performed.

* * * * *

UNITED STATES PATENT AND TRADEMARK OFFICE

CERTIFICATE OF CORRECTION

PATENT NO. : 6,651,976 B2
DATED : November 25, 2003
INVENTOR(S) : Ohfuchi

It is certified that error appears in the above-identified patent and that said Letters Patent is hereby corrected as shown below:

Title page,
Item [30], should read:
-- [30] Foreign Application Priority Data
Jun. 7, 2001 (JP) …….. 2001-172860 --

Signed and Sealed this

Ninth Day of March, 2004

JON W. DUDAS
*Acting Director of the United States Patent and Trademark Office*